US007311196B2

(12) United States Patent
Kim

(10) Patent No.: US 7,311,196 B2
(45) Date of Patent: Dec. 25, 2007

(54) HINGED NECKTIE CONTAINER

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 466 days.

(21) Appl. No.: 10/929,881

(22) Filed: Aug. 30, 2004

(65) Prior Publication Data

US 2006/0042972 A1 Mar. 2, 2006

(51) Int. Cl.
*B65D 85/18* (2006.01)

(52) U.S. Cl. ..... 206/278; 206/457

(58) Field of Classification Search ..... 206/278, 206/297, 299, 457, 458, 459.5; 229/115, 229/116

See application file for complete search history.

(56) References Cited

U.S. PATENT DOCUMENTS 1,048,175 A * 12/1912 Kelly ..... 206/278
1,131,135 A * 3/1915 Hudson ..... 229/77
1,668,572 A * 5/1928 Parmele ..... 206/292
3,664,572 A * 5/1972 Puchkoff et al. ..... 206/299
6,237,761 B1 * 5/2001 Godshaw et al. ..... 206/297
2005/0150807 A1 * 7/2005 Siwak et al. ..... 206/542

* cited by examiner

*Primary Examiner*—Luan K Bui
(74) *Attorney, Agent, or Firm*—Darby & Darby P.C.

(57) ABSTRACT

A container for storing a necktie comprises a bottom, and a plurality of side walls extending from the bottom. The side walls include a back side wall, a front side wall, and at least two shoulder side walls. A top cover sized to seat upon the side walls is also included. The top cover is attached to the back side wall and to a front cover. The top cover and front cover include an outer surface having a first color scheme, and the outer surface of the front side wall include an outer surface having a second color scheme, different from the first color scheme which partially frames an at least triangularly shaped front cover when in the closed position.

15 Claims, 5 Drawing Sheets

HINGED NECKTIE CONTAINER

FIELD OF THE INVENTION

The present invention relates to a display and packaging apparatus for retaining a necktie.

BACKGROUND OF THE INVENTION

Neckties are typically displayed on horizontal racks in a display case, or on a counter top. On occasion, particular neckties are showcased in decorative containers which can be placed on the counter tops of display cases, near cash registers, or at other locations throughout a vendor's store. Several forms for individually packaging and displaying neckties are known.

Packages for neckties (e.g., a single necktie, multiple neckties or neckties with shirts) have been fabricated in various forms. Such containers can assist in the display of neckties to consumers. These containers range from storing multiple neckties lengthwise in a single removable-top cardboard box to storing an individual necktie in its own box. Regarding the latter arrangement, the necktie is usually folded lengthwise along its center and laid flat within the box. This arrangement is common of all prior-art necktie packaging containers and can be troublesome. Customers may remove neckties from their respective boxes in order to try on or show to a friend. When removed, these neckties are not always placed back in the correct box, may be left lying loose on counter-tops, or relocated to a remote place within the store.

The removal of neckties from their boxes can be problematic because pricing and product information is typically on the box in lieu of the tie. Misplaced neckties can lead to inaccurate pricing and consumer confusion. Additionally, when several neckties are disjoined from their respective boxes the task of rejoining each necktie in its correct box can be tedious and time consuming, requiring additional labor and expense on the part of the vendor.

While individually packaging and displaying neckties can provide an eye-catching way of attracting consumers to the product, no particular structure is provided for securing or mounting the necktie therein, preventing its shift within the box, its ready removal from the box, or its separation from pricing/product information on the box.

The present invention addresses these and other needs.

SUMMARY OF THE INVENTION

Disclosed is a container for storing a necktie having a color scheme. The container comprises a bottom and side walls which extend from the bottom. The sidewalls define a top opening opposite the bottom and an inner volume suitable for the placement of a tie therein. The side walls include a back side wall, a front side wall, and at least two shoulder side walls. Also included is a top cover sized to seat upon the side walls and having a back edge and a front edge. A first hinge connects the back edge of the top cover to the back side wall. It permits the top cover to travel between open and closed positions.

The container further includes a front cover having at least a triangular shape and preferably a pentagonal shape. Also included is a second hinge connecting the front edge of the top cover to the front cover. The second hinge permits the front cover to be positioned in parallel relation to the front side wall, when the top cover is in the closed position.

The top cover and front cover have an outer surface having a first color scheme. The outer surface of the front side wall has a second color scheme, which is different from the first color scheme. Thus, the front side wall partially frames the pentagonal front cover when in the closed position.

In a further development, the first color scheme is similar to or coordinate with a color scheme featured on a necktie placed within the container. Furthermore, the front and top cover's outer surfaces comprise a material which has tactile properties that emulate or copy corresponding tactile properties of externally visible material of the necktie.

These and other features and aspects of the invention can be understood from the accompanying drawing figures and detailed description of certain disclosed embodiments.

DETAILED DESCRIPTION OF THE DISCLOSED EMBODIMENTS

Figure 1:
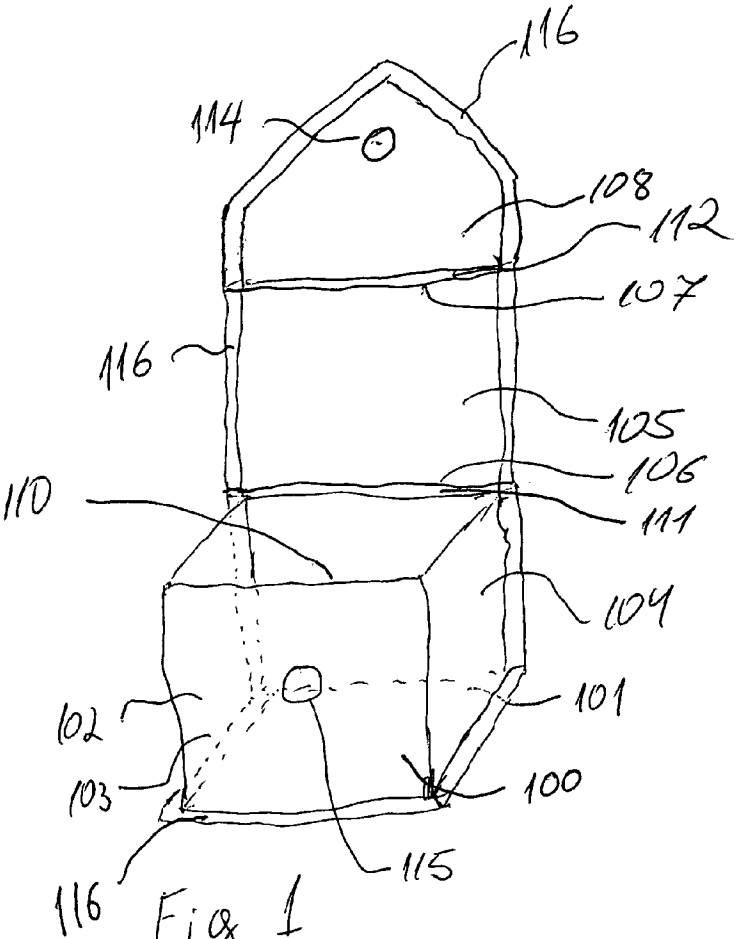
FIG. 1 is a diagram of an open necktie container.

FIG. 1 shows an embodiment of the present invention in its open state. The container of FIG. 1 comprises a bottom 100. As shown, the bottom comprises a square surface, however, in alternate embodiments, the bottom may have different shapes such as, e.g., a rectangle, a polygon with six or more edges. The bottom may also have half circle or otherwise curved edges.

A plurality of side walls 101, 102, 103, 104 extend from the bottom. If the bottom includes more than four edges, the number of side walls is accordingly higher. If the bottom has curved edges, the side walls corresponding to the curved edges are also curved. As shown, the side walls are generally perpendicular to the surface of the bottom. In alternate embodiments, the side walls may extend from the bottom at various angles, and need not be parallel to each other. Side wall 102 is the front side wall, and side wall 104 is the back side wall. Sidewalls 103 and 101 are the shoulder side walls. If the shape of the bottom is different, there may be additional shoulder side walls. The side walls and the bottom together define an inner volume 110. The inner volume is suitable for the placement of a tie therein. Preferably, the inner volume is sized to accommodate a rolled up tie.

A top cover 105 includes a front edge 107 and a rear edge 106. The top cover is sized to sit upon the side walls. Preferably, the shape of the top is such that it allows it to cover the opening created by side walls 101-104. In the shown embodiment, the top cover has the same shape and size as the bottom.

A first hinge 111 connects the top cover 105 to the back side wall 104. Various types of hinges may be used. For example, band of flexible material, such as fabric, may connect the rigid top cover to the back side wall. Alternatively, a butterfly hinge, a butt hinge, a barrel hinge, or a piano hinge, as well as others may be used. The hinge allows the top cover to be moved between a closed state, wherein the top cover is seated upon the side walls and an open state, wherein the top cover is displaced from the sidewalls and thus allows access to the inner volume 110.

A front cover 108 is connected to the top cover by a second hinge 112. The second hinge may be of the types listed above, although it does not need to be of the same type as the first hinge. The front cover is shaped to evoke the lower portion of a necktie in the mind of the average consumer. Thus, the front cover is preferably shaped as a pentagon, and more specifically as the type of pentagon resulting from placing the base of an isosceles triangle along the edge of a rectangle. The hinge 112 allows the front cover to be placed against the front side wall 102 when the top cover 105 is in its closed state.

A first closure element 114 is placed on the front cover 108. A second closure element 115 is placed on the front side wall 102. The first and second closure elements are compatible as to allow a relatively secure closure of the container when the front cover 114 is placed against the front side wall 102. Preferably, the closure elements comprise magnets that are placed within (that is, which are sealed in releases, slots, or depressions in) the front cover and the front side wall, respectively as to be invisible to the naked eye.

The sidewalls, bottom and covers described above may be manufactured from various materials, such as plastic, cardboard, wood or others.

Portions 100-105, and 108 each comprise inner and outer surfaces. For each portion, the outer surface is the surface that is visible when the container is closed.

Figure 2:
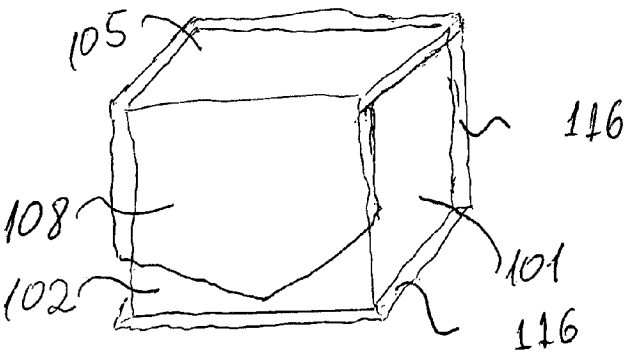
FIG. 2 is a diagram of a closed necktie container.

FIG. 2 shows the container in a closed state. As discussed above, the front cover 108 is preferably shaped to evoke a necktie in the mind of a consumer. In the preferred embodiments, this impression is further strengthened by the colors of the various outer surfaces. Thus, the color of the outer surface of front cover 108 is chosen so that it contrasts the color of outer surface of front side wall 102. Furthermore, the color of outer surface of the front cover 108 may be chosen to resemble the color of a necktie. In a further development, the color of the front cover is the same or similar to or coordinate with the color of a necktie which is placed within the container. Thus, the front cover may comprise any designs or patterns that are featured by the necktie.

A neutral color, such as white may be chosen for the outer surface of the front side wall 102. Alternatively, the color of the outer surface of front side wall 102 may be chosen to coincide with the color of a shirt that would make a good combination with the necktie included in the container.

To further enhance the impression of a necktie, the outer surface of the front cover 108 may comprise a fabric, which is similar to the eye and to the touch to the fabric of the necktie placed within the container. Thus, the fabric of the container preferably has similar tactile properties to the fabric of the necktie placed within the container (e.g. both are silk).

In a further development, the outer surfaces of top cover 105, back side wall 104, and bottom 100 may each be colored in the color scheme of front cover 108. If fabric is used for the outer surface of front color 108, the outer surfaces of top cover 105, back side wall 104 and bottom 100 may be similarly treated. Thus, an impression is created that a necktie is wrapped around the container. To improve contrast, the outer surfaces of shoulder side walls 101 and 103 may be colored in the color scheme of the outer surface of front side wall 102.

The embodiment shown in FIGS. 1 and 2 includes an overhang region 116. The overhang region 116 is a region of the inner surfaces of the bottom 100, back side wall 104, top cover 105, and front cover 108 which extends beyond the neighboring side walls and is thus visible even when the container is in its closed state (see FIG. 2). The overhang region may be colored according to the color scheme of the outer surface of the front cover 108. Similarly, the overhang region may comprise the fabric material of the outer surface of the top cover 108.

In the preferred embodiment, the inner surfaces of portions 100-105, and 108 feature a third color which is distinct from the colors of the side walls and the outer surfaces of the above portions. If overhang regions 116 are used, the third color is preferably not applied to the overhang regions. The third color may be black, or another color chosen to improve the appearance of the necktie when the container is open.

Figure 3:
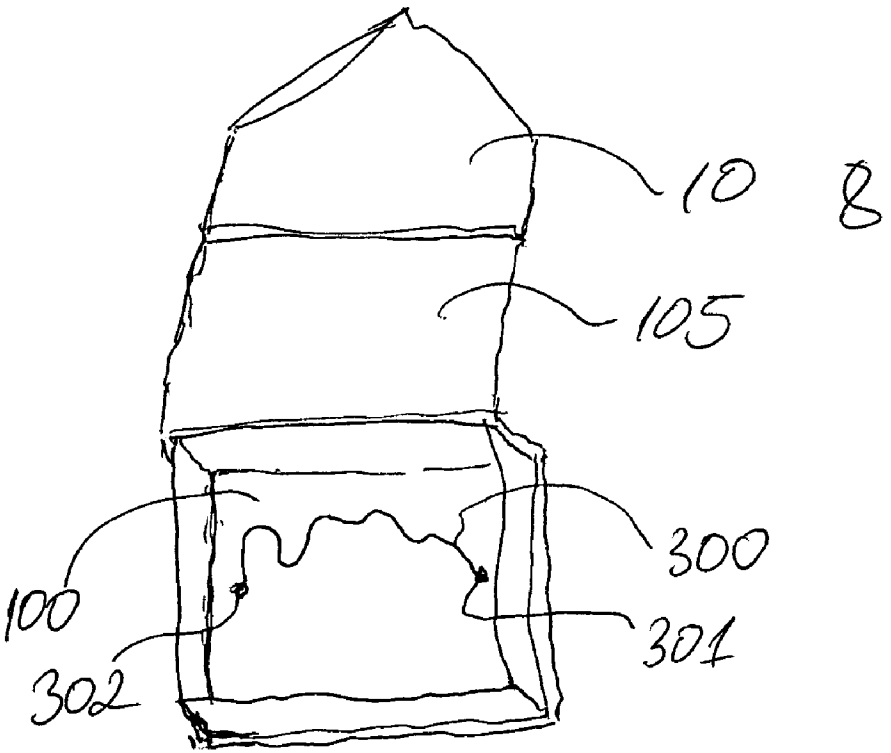
FIG. 3 is a diagram showing a top view of an open necktie container.

FIG. 3 is a top view of the container in its open state. The preferred embodiment of the invention features a member 300, which is used to retain a necktie within the container. Member 300 ensures that the stored necktie is not misplaced during movement of the container. It also ensures that the necktie is not taken out of the container by consumers in a retail environment. It is preferred that member 300 is an elastic chord. Thus, in use, the necktie is wrapped around member 300, and thus secured in the container. Member 300 is attached to the bottom 100 at two spaced apart positions—301 and 302. Bottom 100 may comprise the appropriate features (such as holes) for attachment of member 300 at positions 301 and 302.

Figure 4:
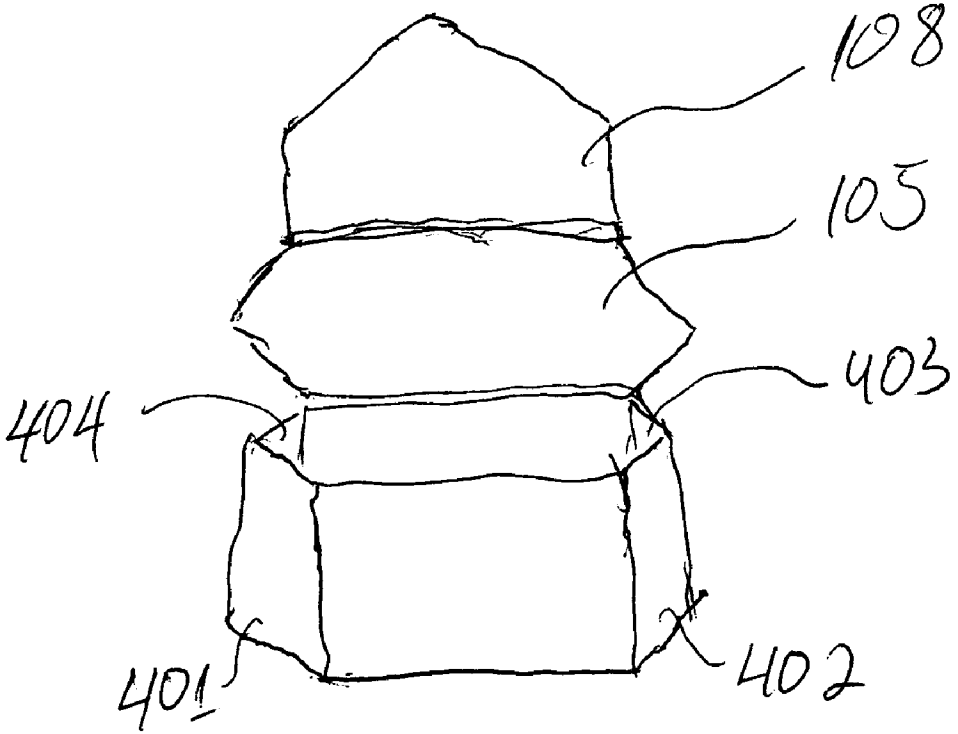
FIG. 4 is a diagram of a alternative embodiment of the necktie container.

FIG. 4 shows an alternative embodiment of the container of the present invention. In this embodiment, the bottom and the top both have the shapes of irregular hexagons. There are four side walls 401-404.

Figure 5:
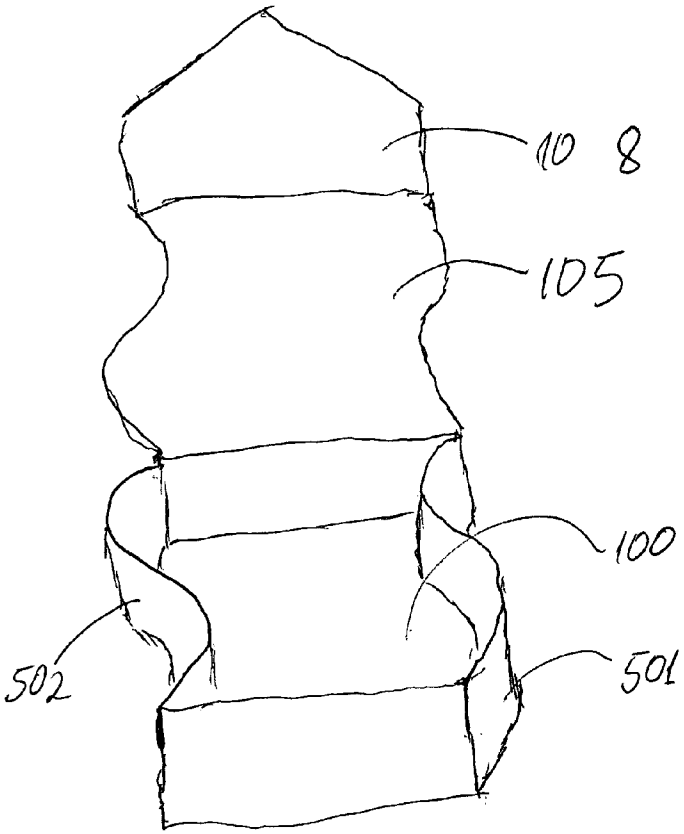
FIG. 5 is a diagram of yet another alternative embodiment of the necktie container.

FIG. 5 illustrates yet another alternative embodiment of the container of the present invention. In this embodiment, the bottom 100 and top cover 105 include curved edges. The two side walls 501 and 502 are also curved. Various embodiments, such as the ones illustrated in FIGS. 4 and 5 may be combined with different methods of storing/folding the necktie within the container in order to improve the appearance of the necktie and container combination.

Figure 6:
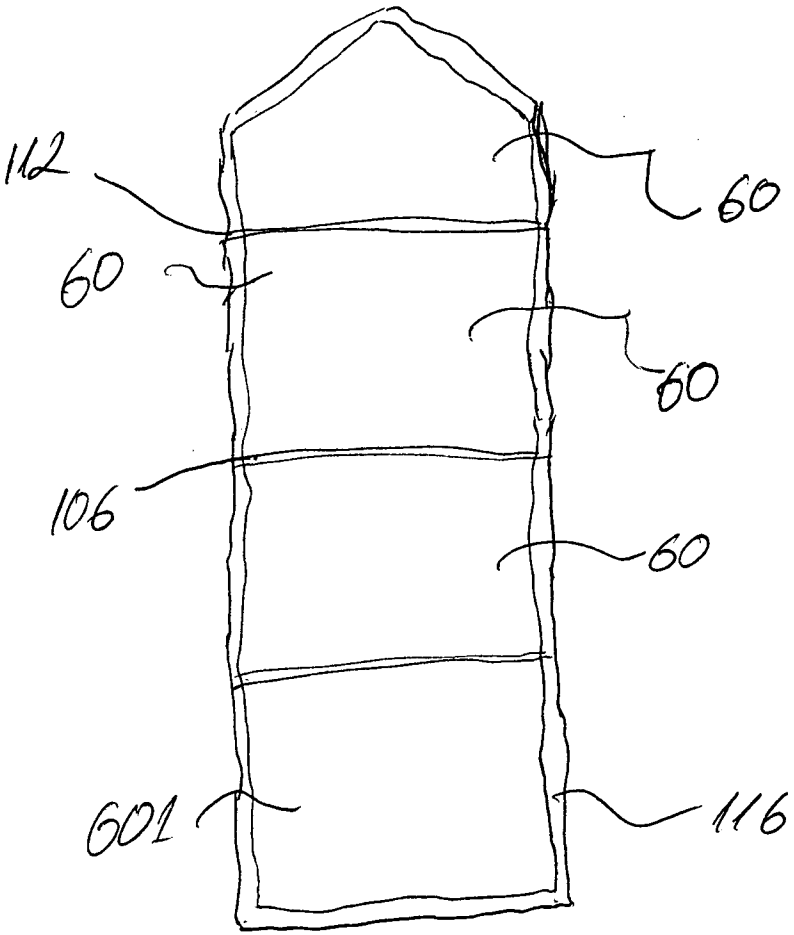
FIG. 6 is a diagram illustrating a method for manufacturing the necktie container.
Figure 6:
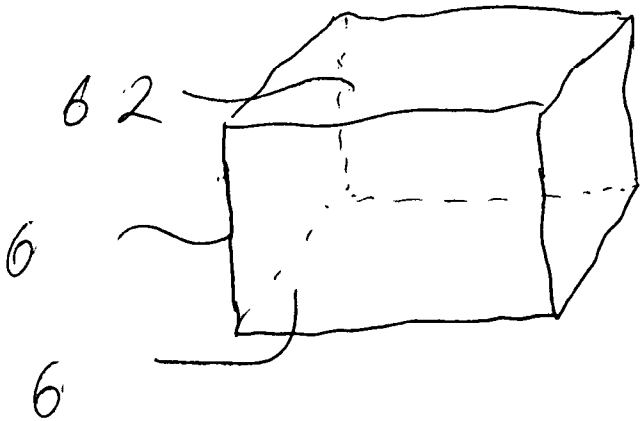

FIG. 6 illustrates a method for manufacturing the necktie container. A open topped box 610 is provided. Manufacturing of such a box is known in the art. Also provided is a strip 600, which includes four portions—601-604. The portions are hingedly connected to each other. The strip 600 is attached to box 610 to form the container of the present invention. Portion 601 is attached to the bottom of the box 611, portion 602 is attached to the back of the box 612. Portions 603 and 604 remain detached and form the top cover 105 and the front cover 108, respectively. The bottom of the box 611 and portion 601 combined to form the bottom 100, while the back of the box 612 and portion 602 combine to form the back side wall 104. The attachments may be realized in any known manner, such as, for example, by the use of glue.

The various surfaces of strip 600 and box 610 are colored according to the desired colors of the resulting surfaces of the container, which are described above. A fabric cover is applied to the strip 600, for embodiments featuring fabric surfacing (see above). Also, if an overhang region 116 is featured, it is colored and/or covered by fabric accordingly. These steps are preferably performed before the attachment of the strip 600 to the box 610.

An additional advantage to using a fabric cover, is that the fabric may be utilized to form the hinges connecting the various portions of the strip 600. These hinges include hinges 106 and 112, which must remain operational after the container is manufactured.

The container described above may provide many benefits for consumers and retailers alike. Retailers will be able to improve the quality of their displays while eliminating the disorder that often results when customers are allowed to handle unpackaged neckties. Since the neckties are attached to their respective containers, retailers can greatly reduce the theft of neckties, without inconveniencing customers. In addition, customers may receive the container when purchasing a necktie, and later use the container for storage of the necktie.

The invention has been described in connection with particular embodiments thereof but is defined solely by the claims appended hereto.

I claim:

1. A container for storing a necktie having a color scheme, the container comprising:

a bottom;

side walls extending from the bottom and defining a top opening opposite the bottom and an inner volume suitable for the placement of a tie therein, the side walls including a back side wall, a front side wall, and at least two shoulder side walls;

a top cover sized to seat upon the side walls and having a back edge and a front edge;

a first hinge connecting the back edge of the top cover to the back side wall, the first hinge permitting the top cover to travel between open and closed positions;

a front cover having a triangular shape; and a second hinge connecting the front edge of the top cover to the front cover and permitting the front cover to be positioned in parallel relation to the front side wall, when the top cover is in the closed position, wherein the top cover and front cover include an outer surface having a first color scheme which coordinates with the color scheme of the necktie, and the front side wall includes an outer surface having a second color scheme, different from the first color scheme which partially frames the triangular front cover when in the closed position.

2. The container of claim 1, wherein the front cover includes a first closure element and the front side wall includes a second closure element compatible with the first closure element.

3. The container of claim 2, wherein one of the first and second closure elements comprises a magnet.

4. The container of claim 1, wherein the necktie comprises an exteriorly visible outer material and wherein the outer surface of the top cover and the front cover comprise a fabric material colored according to the first color scheme, said fabric material having one or more tactile properties that emulate or copy corresponding tactile properties of the exteriorly visible material.

5. The container of claim 4, wherein the back side wall comprises an inner and outer surface, the outer surface of the back side wall comprising a fabric material having the first color scheme, said fabric material having one or more tactile properties that emulate or copy corresponding tactile properties of the exteriorly visible material.

6. The container of claim 5, wherein the shoulder side walls each comprise an inner and outer surface, and the wherein outer surfaces of the shoulder side walls have second color scheme.

7. The container of claim 6, wherein the inner surfaces of the front cover, the top cover, the front side wall, the back side wall, and the shoulder side wall each have a third color scheme.

8. The container of claim 7, wherein the bottom includes an inner and an outer surface, and wherein the inner surface of the bottom has the third color scheme, the outer surface of the bottom comprises a fabric material having the first color scheme, said fabric material said fabric material having one or more tactile properties that emulate or copy corresponding tactile properties of the exteriorly visible material.

9. The container of claim 8, further including a member affixed to the container and configured to retain the necktie so as to normally prevent separation of the necktie from the container.

10. The container of claim 9, wherein the member is mounted to the container at least two spaced locations within the container.

11. The container of claim 1, further including a member affixed to the container and configured to retain the necktie so as to normally prevent separation of the necktie from the container.

12. The container of claim 11, wherein the member is mounted to the container at least two spaced locations within the container.

13. The container of claim 1, wherein the at least triangular shape is a pentagonal shape having a broad base connected to the second hinge, parallel side walls depending from the base, and non-parallel edges that converge about a center line of the base.

14. The container of claim 13, wherein the top cover further includes a mount and a closure element.

15. A container for storing a necktie having a color scheme, the container comprising:

a bottom;

side walls extending from the bottom and defining a top opening opposite the bottom and an inner volume suitable for the placement of a tie therein, the side walls including a back side wall, a front side wall, and at least two shoulder side walls;

a top cover sized to seat upon the side walls and having a back edge and a front edge;

a first hinge connecting the back edge of the top cover to the back side wall, the first hinge permitting the top cover to travel between open and closed positions;

a front cover having a triangular shape;

a second hinge connecting the front edge of the top cover to the front cover and permitting the front cover to be positioned in parallel relation to the front side wall, when the top cover is in the closed position, wherein the top cover and front cover include an outer surface having a first color scheme which coordinates with the color scheme of the necktie, and the outer surface of the front side wall includes an outer surface having a second color scheme, different from the first color scheme which partially frames the triangular front cover when in the closed position; and wherein the necktie comprises an exteriorly visible outer material and wherein the outer surface of the top cover and the front cover comprise a fabric material colored according to the first color scheme, said fabric material having one or more tactile properties that emulate or copy corresponding tactile properties of the exteriorly visible material.

* * * * *